US009194336B2

(12) United States Patent
Watanabe et al.

(10) Patent No.: US 9,194,336 B2
(45) Date of Patent: Nov. 24, 2015

(54) STARTING DEVICE AND CARBURETOR SUPPLYING FIXED AMOUNT OF FUEL

(75) Inventors: Hideki Watanabe, Iwate (JP); Tamotsu Saito, Iwate (JP)

(73) Assignee: ZAMA JAPAN KABUSHIKI KAISHA, Iwate (JP)

( * ) Notice: Subject to any disclaimer, the term of this patent is extended or adjusted under 35 U.S.C. 154(b) by 953 days.

(21) Appl. No.: 13/189,295

(22) Filed: Jul. 22, 2011

(65) Prior Publication Data

US 2012/0055450 A1 Mar. 8, 2012

(30) Foreign Application Priority Data

Sep. 3, 2010 (JP) ..... 2010-198165

(51) Int. Cl.
*F02M 1/16* (2006.01)
*F02M 37/16* (2006.01)
*F02M 17/04* (2006.01)

(52) U.S. Cl.
CPC ..... *F02M 1/16* (2013.01); *F02M 17/04* (2013.01); *F02M 37/16* (2013.01)

(58) Field of Classification Search
CPC ..... F02N 19/001; F02N 11/08; F02N 99/008; F02N 3/02; F02M 1/16; F02M 63/0225; F02M 59/102; F02M 1/00; F02M 2700/4311; F02M 7/106; F02M 1/10; F02M 7/28; F02M 11/02; F02M 37/16; F02M 17/04; F02B 75/34; F02B 2053/005; F28C 1/00; F24F 6/04
See application file for complete search history.

(56) References Cited

U.S. PATENT DOCUMENTS

| | | | | | |
|---|---|---|---|---|---|
| 3,620,202 | A | * | 11/1971 | Ross | 123/179.16 |
| 4,053,542 | A | * | 10/1977 | Niebrzydoski | 261/23.2 |
| 4,271,093 | A | * | 6/1981 | Kobayashi | 261/34.1 |
| 4,394,852 | A | * | 7/1983 | Tuckey et al. | 123/179.9 |
| 4,811,901 | A | * | 3/1989 | Stevens et al. | 239/138 |
| 4,936,267 | A | * | 6/1990 | Gerhardy et al. | 123/179.16 |
| 5,058,544 | A | * | 10/1991 | Guntly et al. | 123/179.9 |
| 5,339,787 | A | * | 8/1994 | Jungquist et al. | 123/514 |
| 6,000,369 | A | * | 12/1999 | Koizumi | 123/179.16 |
| 2009/0229579 | A1 | * | 9/2009 | Fujinuma et al. | 123/512 |

FOREIGN PATENT DOCUMENTS

JP 2003-254164 9/2003

* cited by examiner

*Primary Examiner* — Lindsay Low
*Assistant Examiner* — Brian P Monahon
(74) *Attorney, Agent, or Firm* — One LLP

(57) ABSTRACT

A starting device for feeding a quantity of fuel from the fixed-quantity fuel chamber to an intake passage during start-up having a manually operated primary pump for suctioning/pumping fuel and arranged on a fuel introduction path connected along a fuel-feeding path; and a fixed-quantity fuel chamber for temporarily storing fuel delivered from the primary pump. An internal wall of the fixed-quantity fuel chamber undergoes elastic displacement, allowing its internal capacity to expand/shrink within a predetermined range; the fixed-quantity fuel chamber is connected to a fuel delivery path that communicates with the intake passage side and has a manually operated open/close valve; the valve is opened in a state in which, due to the primary pump being operated, the fixed-quantity fuel chamber is filled with a predetermined quantity of fuel while enlarging its internal capacity, whereby it shrinks due to an elastic contraction force and the fuel.

11 Claims, 4 Drawing Sheets

STARTING DEVICE AND CARBURETOR SUPPLYING FIXED AMOUNT OF FUEL

BACKGROUND OF THE INVENTION

1. Field of the Invention

The present invention relates to a starting device for delivering starting fuel using a manually operated primary pump to start an engine, and a carburetor using the same.

2. Description of the Related Art

Known starting devices for carburetors include those that use a choke value, or those in which the engine is started by feeding a rich mixture into the engine using the bystart method or a pump that utilizes the pulse pressure of the engine. In starting devices of such description, the fuel is drawn out from the carburetor after a starting operation is performed by the operator using a recoil rope or another method and negative pressure is generated in the engine. Since it is necessary to perform the starting operation repeatedly until the fuel reaches the intake manifold, the crankcase, the scavenging passage, and the fuel chamber, the operator is subjected to a laborious workload.

Meanwhile, carburetors for supplying fuel to general-purpose engines provided to lawnmowers, small watercraft, and similar applications are conventionally equipped with a carburetor starting device having a manually operated primary pump in which a suction valve/discharge valve and a cup-shaped container made from an elastic resin are combined, as described in, e.g., JP-A 2003-254164.

In a carburetor provided with a starting device of such description, the operator can use the primary pump to deliver fuel to the intake manifold or the crank case before performing the starting operation, and the engine can be started by a relatively concise starting operation. However, this method presents a problem in that if the primary pump is actuated excessively, the engine becomes flooded by fuel, making it difficult to start the engine.

SUMMARY OF THE INVENTION

The preset invention is intended to resolve the types of problems described above, and is aimed at making it possible to deliver an appropriate quantity of starting fuel through a simple operation and obtaining a satisfactory engine starting performance in relation to an engine starting device comprising a manually operated primary pump.

In order to solve the above problem, the present invention is a starting device comprising: a manually operated primary pump for suctioning/pumping fuel, the primary pump being arranged on a fuel introduction path connected partway along a path for feeding fuel to an engine; and a fixed-quantity fuel chamber for temporarily storing fuel that has been delivered from the primary pump; the starting device feeding a fixed quantity of starting fuel from the fixed-quantity fuel chamber to an intake passage of the engine during engine start-up; wherein at least a part of an internal wall of the fixed-quantity fuel chamber undergoes elastic displacement, allowing the internal capacity of the fixed-quantity fuel chamber to expand/shrink within a predetermined range; the fixed-quantity fuel chamber is connected to a fuel delivery path that communicates with the intake passage side, the fuel delivery path having a manually operated open/close valve provided partway therealong; the open/close valve of the fuel delivery path is manually opened in a state in which, due to the primary pump being operated, the fixed-quantity fuel chamber is filled with a predetermined quantity of starting fuel while the internal capacity of the fixed-quantity fuel chamber is enlarged, whereby the fixed-quantity fuel chamber shrinks due to an elastic contraction force and discharges a given quantity of starting fuel to a side towards the intake passage via the fuel delivery path.

Thus, the starting device has a configuration in which a fixed-quantity fuel chamber, which has a function of discharging stored fuel using an elastic contraction force and of feeding a given quantity of starting fuel to the engine, is arranged downstream in relation to the primary pump; and manually opening an open/close valve, which blocks the fuel delivery path downstream of the fixed-quantity fuel chamber, feeds a given quantity of starting fuel. An appropriate quantity of starting fuel is thereby fed to the engine through a simple operation.

Also, in the starting device described above, if a fuel-ejecting path for ejecting excess fuel extends from the fixed-quantity fuel chamber and has a constricted section, which is narrower than a narrowest portion of the fuel delivery path; wherein excess fuel charged into the fixed-quantity fuel chamber by excessive operation of the primary pump is ejected, then an appropriate quantity of starting fuel can be readily fed while facilitating the task of filling the fixed-quantity fuel chamber using the primary pump.

Also, the fixed-quantity fuel chamber may be equipped with a locking means, which serves as a stopper for locking the internal wall that has undergone displacement to an extent at which the internal capacity has expanded to a predetermined level, the internal wall being locked at the associated position, and for automatically stopping operation of the interior wall in the direction of contraction; wherein, in association with the open/close valve being opened, a state of locking applied by the locking means is cancelled, the fixed-quantity fuel chamber is caused to contract, and the starting fuel is discharged. The operation of discharging the starting fuel can thereby be satisfactorily performed.

Also, a carburetor may be integrally equipped with the starting device described above, whereby merely providing the carburetor to a fuel-feeding system for an engine will make it possible for the functions described above to be realized.

According to the present invention, in which a fixed-quantity fuel chamber for discharging fuel using an elastic contraction force is arranged downstream in relation to the primary pump, and manually opening the open/close valve in the fuel delivery path causes a given quantity of starting fuel to be fed, it is possible to deliver an appropriate quantity of starting fuel through a simple operation and to obtain a satisfactory engine starting performance.

DESCRIPTION OF THE PREFERRED EMBODIMENTS

Embodiments of the present invention are described below with reference to the accompanying drawings.

Figure 1:
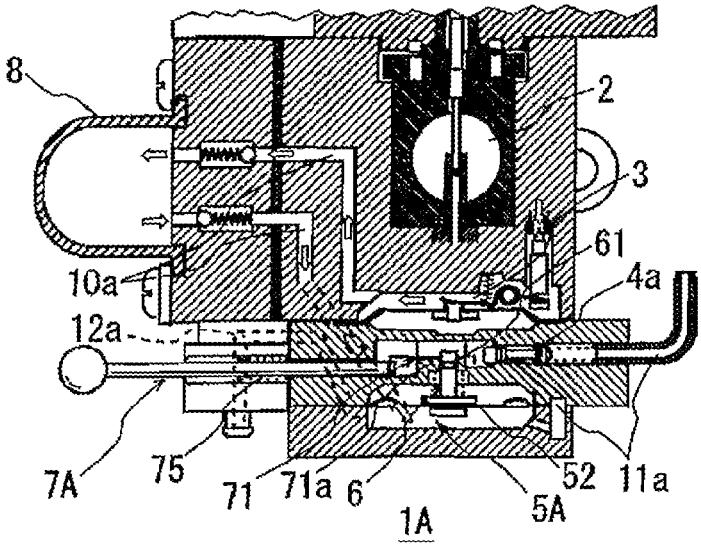
FIG. 1 is a partial vertical cross-section view of a carburetor equipped with a starting device according to the present embodiment.

FIG. 1 shows a partial vertical cross-section view of a carburetor 1A, integrally equipped with a starting device according to the present embodiment. The configuration of the carburetor portion, which is penetrated by an intake passage 2 and which feeds vaporized fuel using a fuel nozzle, is the same as conventional examples. Therefore, a detailed description of the carburetor portion will not be provided, and a detailed description will be provided for the configuration of the accompanying starting device portion.

A primary pump 8, which has an introduction valve and a discharge valve on the inside and a cup-shaped member formed from an elastic resin and exposed outwards, is provided partway along a fuel introduction path 10*a* extending from a metering chamber 3 of the carburetor portion. The fuel introduction path 10*a* extending from the primary pump 8 is connected to a fixed-quantity fuel chamber 5A of the starting device portion provided below the metering chamber 3. By manually operating the primary pump 8, it is possible to suction/pump fuel from the metering chamber 3, and introduce/charge the fuel into the fixed-quantity fuel chamber 5A as starter fuel.

One of the surfaces that form the internal wall of the fixed-quantity fuel chamber 5A is formed from a diaphragm 52. A chamber on the opposite side of the diaphragm 52 has a guide rod 6 formed of, e.g., a metal, protruding from the center of the diaphragm 52. A coil-shaped diaphragm spring 51 is disposed in a compressed state between the diaphragm 52 and the top wall, in a state of being penetrated by the guide rod 6; and the diaphragm 52 is urged by the diaphragm spring 51 in the direction of contraction of the fixed-quantity fuel chamber 5A. Therefore, the fixed-quantity fuel chamber 5A is capable of deforming in an elastic manner accompanied by a displacement, in the vertical direction shown in the drawing, of the internal wall formed by the diaphragm 52; and of expanding/shrinking within a predetermined range in terms of internal capacity.

A fuel delivery path 11*a*, which communicates with the side towards the intake passage 2, extends from the fixed-quantity fuel chamber 5A. An open/close valve 4*a*, which is opened by pressing a manually operated starting bar 7A and automatically closed by a valve spring 41, is provided partway along the fuel delivery path 11*a*. Manually opening the open/close valve 4*a* in a state in which the fixed-quantity fuel chamber 5A is expanded in terms of internal capacity and filled with a predetermined quantity of starting fuel causes a given quantity of starting fuel to be discharged towards the side towards the intake passage and fed to the engine.

The distal-end side of the guide rod 6, which protrudes from the center of the aforedescribed diaphragm 52, has a notch 61 formed along the circumferential direction. The distal end of the guide rod 6 penetrates through to a space partitioned off by the top wall against which the diaphragm spring 51 is in contact. In the side towards the space partitioned off as described above, a plate-shaped stopper 71, which has an elliptical insertion hole 71*a* formed at the center in the direction perpendicular to the central axis of the guide rod 6, is provided so that the distal-end side of the guide rod 6 penetrates the insertion hole 71*a* and the stopper 71 is capable of sliding in the direction perpendicular to the direction of penetration.

A distal-end side of the starting bar 7A, which has been inserted from the side surface of the starting device portion, connects to the base-end side of the stopper 71. The distal-end side of the starting bar 7A is exposed to the outside, forming a grip for manual operation. The starting bar 7A is urged by a coil spring 75 in an outward direction along the central axis.

The edge of the insertion hole 71*a* of the stopper 71 and the notch 61 of the guide rod 6 form locking means, which is a stopper for locking the position of the diaphragm 52 so as to maintain the state in which the fixed-quantity fuel chamber is filled with the starting fuel. When the internal capacity of the fixed-quantity fuel chamber 5A has expanded to a predetermined level, i.e., when the guide rod 6 has moved upwards to a point at which the notch 61 reaches the height of the stopper 71, the urging force applied by the coil spring 75 causes the starting bar 7A and the stopper 71 to be operated in the withdrawing direction and the edge of the insertion hole 71*a* to enter and engage with the notch 61. The movement of the guide rod 6 along the direction of the central axis is thereby locked at this position, and the operation of the fixed-quantity fuel chamber 5A in the direction of contraction is automatically stopped.

Figure 2:
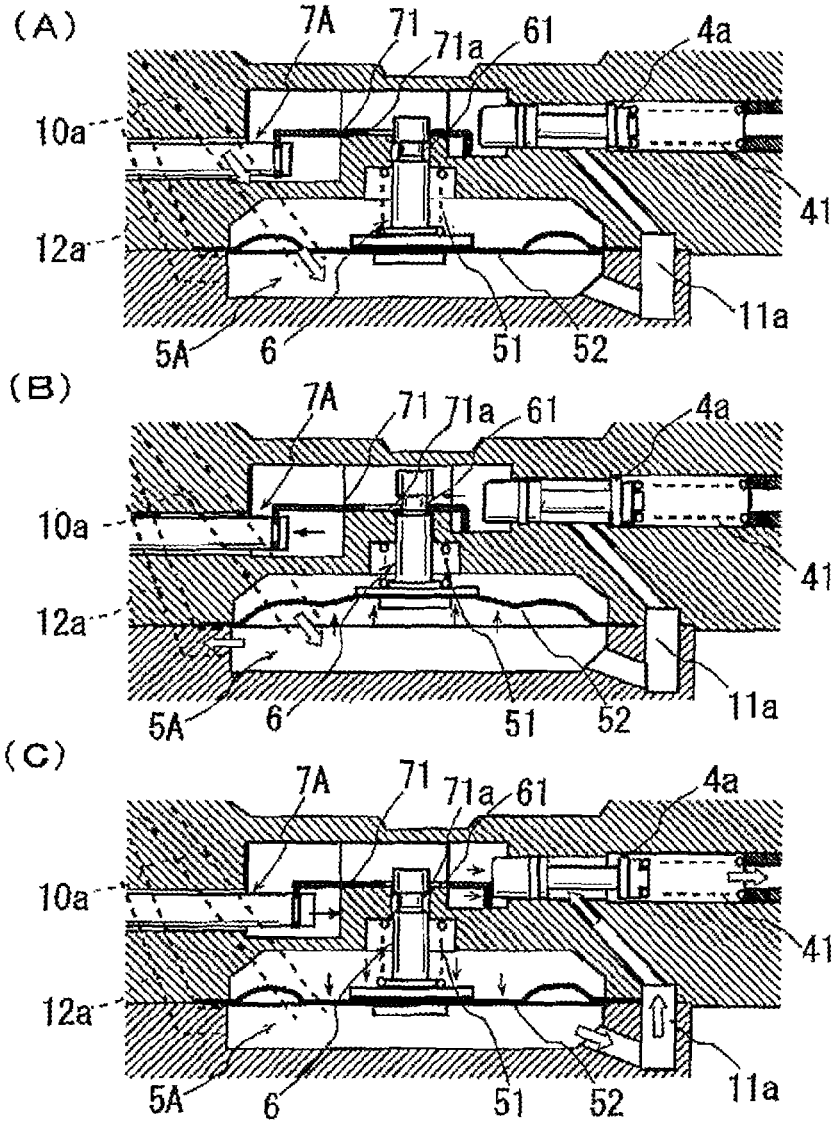
FIGS. 2(A), 2(B), and 2(C) are expanded vertical cross-section views used to illustrate the operation of the starting device shown in FIG. 1.

Next, the operation of the starting device according to the present embodiment will be described with reference to FIG. 2. Looking at FIG. 2(A), fuel that has been suctioned from the metering chamber 3 by manual operation of the primary pump 8 is introduced through the fuel introduction path 10*a* into the fixed-quantity fuel chamber 5A and stored as starting fuel.

Then, operating the primary pump 8 increases the internal capacity of the fixed-quantity fuel chamber 5A, causing the diaphragm 52 to displace upwards while the diaphragm spring 51 is compressed. When the diaphragm 52 approaches the upper limit position, the distal-end-side edge of the insertion hole 71*a* of the stopper 71 engages with the notch 61 of the guide rod 6 as shown in FIG. 2(B), immobilizing the guide rod 6 in this state, and maintaining a state in which a given amount of fuel is stored.

Subsequently operating the primary pump 8 causes the pressure within the fixed-quantity fuel chamber 5A to exceed a predetermined level, and the excess starting fuel to be ejected towards a fuel tank (not shown) through a fuel ejection path 12*a*, in which a constricted section is formed. In this instance, an increase in resistance against the primary pump 8 being pressed allows the operator to detect the fixed-quantity fuel chamber 5A reaching a state of being filled with the starting fuel to a sufficient level and the position of the diaphragm 52 being immobilized by the stopper 71.

Then, as shown in FIG. 2(C), the operator presses the portion of the starting bar 7A that is exposed to the outside (i.e., the starting button), whereby the stopper 71 disengages from the guide rod 6 and the resistance force from the diaphragm spring 51 compresses the starting fuel stored in the fixed-quantity fuel chamber 5A. At the same time, the distal-end-side of the stopper 71 comes into contact with the distal-end-side of the open/close valve 4*a* arranged in the fuel delivery path 11*a*, acts against the urging force from the valve spring 41, and opens the open/close valve 4*a*. The starting fuel stored in the fixed-quantity fuel chamber 5A is forced out towards the side towards the intake passage through the fuel delivery path 11*a*.

Due to the procedure described above, a given quantity of the starting fuel is fed to the engine during engine start-up, and even if the operator operates the primary pump 8 excessively, the excess fuel merely returns to the fuel tank, and there is no risk of the engine being fouled. It is thereby possible to obtain a satisfactory engine starting performance at all times through a simple operation.

Figure 3:
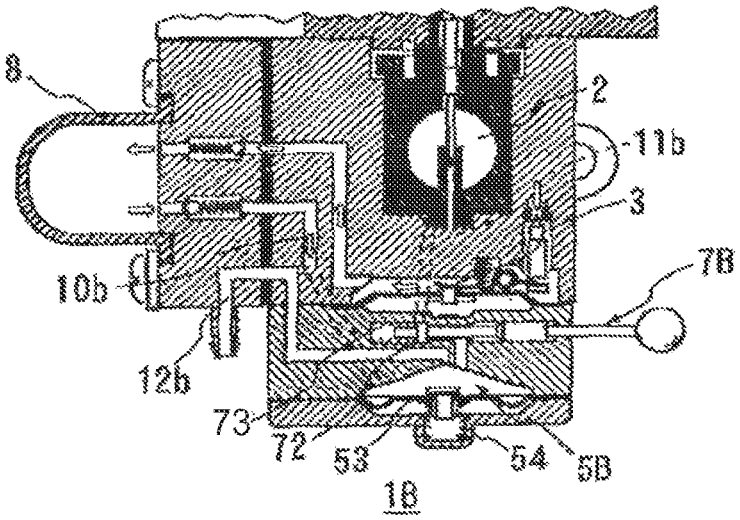
FIG. 3 is a partial vertical cross-section view of a carburetor equipped with a variation of the starting device shown in FIG. 1.
Figure 4:
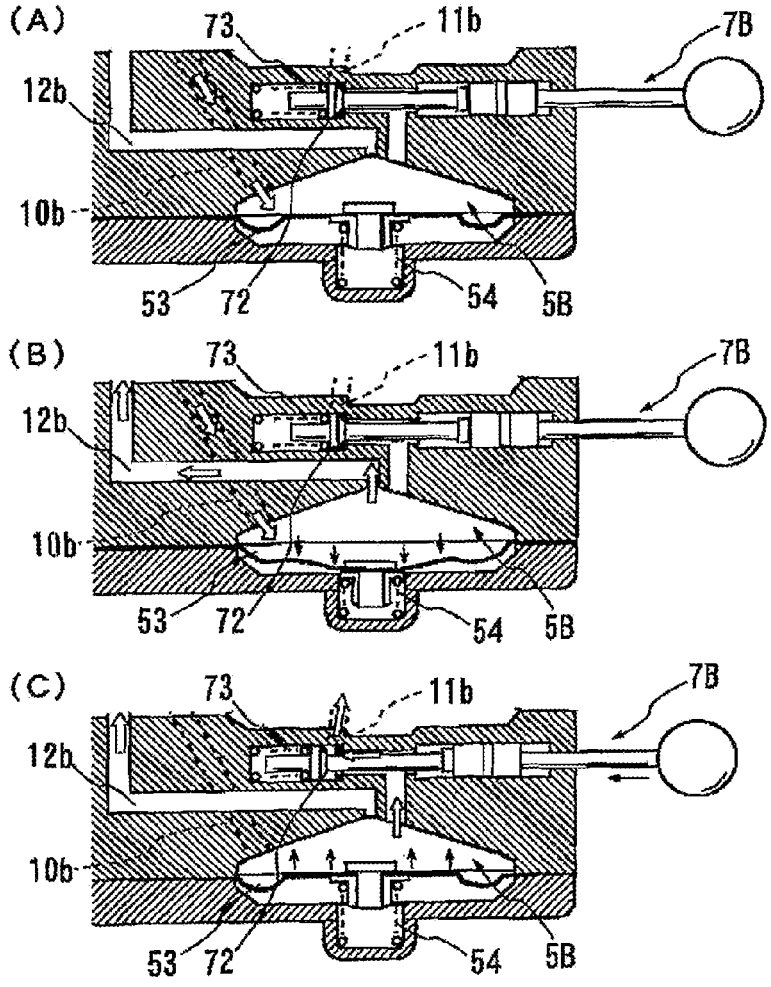
FIGS. 4(A), 4(B), and 4(C) are expanded vertical cross-section views used to illustrate the operation of the starting device shown in FIG. 3.

FIG. 3 shows a carburetor 1B that is an example of a variation of the embodiment described above, and shows a configuration of a starting device that is not provided with means for locking the diaphragm 53. In this example, as shown in FIG. 4(A), the open/close valve 72, which is directly provided on the distal-end-side of the starting bar 7B, is opened by pressing the starting bar 7B and automatically closed by a valve spring 73. The stopper 71 and the guide rod 6 are not provided, and the configuration is simpler than that according to the previous example.

As with the previous example, the operator presses the primary pump 8 provided partway along a fuel introduction path 10b extending from a metering chamber 3 of the carburetor portion, causing a predetermined quantity of starting fuel to be stored in the fixed-quantity fuel chamber 5B as shown in FIG. 4(B); and continues to press the primary pump 8, causing excess fuel to be ejected from the fuel ejection path 12*b* provided with a constricted section. However, in this example, the starting fuel compressed by the diaphragm spring 54 is, over time, caused to pass through the constricted section and be gradually ejected through the fuel ejection path 12*b*. Therefore, when the operator detects, from the resistance on the primary pump 8 or another indicator, the fixed-quantity fuel chamber 5B reaching a state of being filled with the starting fuel to a sufficient degree, the operator is required to press the starting bar 7B within a predetermined time.

The operator pressing the starting bar 7B in a state in which a predetermined quantity of starting fuel is stored in the fixed-quantity fuel chamber 5B causes the fuel delivery path 11*b* to open and the starting fuel to be fed to the engine as shown in FIG. 4(C). With regards to this example of variation and the embodiment described above, a description has been given for a starting device that is integrated with a carburetor; however, this arrangement is not provided by way of limitation. The starting device portion may be provided, separately from the carburetor, to the fuel-feeding system of the engine.

As described above, the present invention makes it possible to deliver an appropriate quantity of starting fuel through a simple operation and to obtain a satisfactory engine starting performance in relation to an engine starting device comprising a manually operated primary pump.

1A, 1B Carburetor
2 Intake passage
4A, 72 Open/close valve
5A, 5B Fixed-quantity fuel chamber
6 Guide rod
7A, 7B Starting bar
8 Primary pump
10*a* 10*b* Fuel introduction path
11*a* 11*b* Fuel delivery path
12*a*, 12*b* Fuel ejection path
41, 73 Valve spring
52, 53 Diaphragm
61 Notch
71 Stopper
71*a* Insertion hole

What is claimed is:

1. A carburetor and starting device, comprising
an intake passage,
a metering chamber,
a manually operated primary pump for suctioning and pumping fuel, the primary pump being arranged on a fuel introduction path in communication on an introduction side with the metering chamber; and
a fixed-quantity fuel chamber for temporarily storing fuel that has been drawn from the metering chamber and delivered from the primary pump; wherein
the starting device feeds a fixed quantity of starting fuel from the fixed-quantity fuel chamber to an the intake passage during engine start-up;
wherein at least a part of an internal wall of the fixed-quantity fuel chamber undergoes elastic displacement, allowing the internal capacity of the fixed-quantity fuel chamber to
expand and contract within a predetermined range;
the fixed-quantity fuel chamber is connected to a fuel delivery path that communicates with the intake passage, the fuel delivery path having a manually operated open/close
valve provided partway there along and biased to a closed position;
the open/close valve of the fuel delivery path is manually opened in a state in which, due to the primary pump being operated, the fixed-quantity fuel chamber is filled with a predetermined quantity of starting fuel while the internal capacity of the fixed-quantity fuel chamber is enlarged,
whereby the fixed-quantity fuel chamber contracts due to an elastic contraction force and discharges a given quantity of starting fuel to the intake passage via the fuel delivery path,
wherein the fixed-quantity fuel chamber is equipped with a locking means for locking the internal wall that has undergone displacement to an extent at which the internal capacity has expanded to a predetermined level, the internal wall being locked at the associated position, and for automatically stopping operation of the interior wall in the direction of contraction; wherein, in association with the open/close valve being opened, a state of locking applied by the locking means is canceled, the fixed-quantity fuel chamber is caused to contract, and the starting fuel is discharged,
wherein the at least a part of the internal wall of the fixed-quantity fuel chamber that undergoes elastic displacement is a diaphragm, wherein the locking means includes a stopper operably couplable to the open/close valve on a first end and a guide rod coupled on a first end to the diaphragm and engageable on a second end with the stopper to lock the diaphragm that has undergone displacement to an extent at which the internal capacity of the fixed-quantity fuel chamber has expanded to a predetermined level, the diaphragm being locked at the associated position and prevented from moving in the direction of contraction.

2. The carburetor and starting device according to claim 1, further comprising a fuel-ejecting path for ejecting excess fuel extends from the fixed-quantity fuel chamber and has a constricted section, which is narrower than a narrowest portion of the fuel delivery path; wherein excess fuel charged into the fixed-quantity fuel chamber by excessive operation of the primary pump is ejected.

3. The carburetor and starting device according to claim 1 further comprising a valve spring biasing the open/close valve to a closed position.

4. The carburetor and starting device according to claim 3 further comprising a starter bar operably coupled on a first end to the open/close valve and operable from a second end exterior to the carburetor and starting device to manually open the open/close valve.

5. The carburetor and starting device according to claim 1 further comprising a starter bar operably coupled on a first end to a second end of the stopper and operable from a second end exterior to the carburetor and starting device to manually open the open/close valve and cancel the state of locking applied by the locking means.

6. The carburetor and starting device according to claim 5 further comprising a coil spring biasing the starter bar and stopper toward a state of locking

7. The carburetor and starting device according to claim 1 further comprising a diaphragm spring urging the diaphragm in a direction of contraction.

8. A carburetor comprising an intake passage, a metering chamber, a fixed-quantity fuel chamber comprising a diaphragm that undergoes elastic displacement, allowing the internal capacity of the fixed-quantity fuel chamber to expand and contract within a predetermined range;

a manually operated primary pump, the primary pump being arranged on a fuel introduction path in communication on an introduction side with the metering chamber and on a discharge side with the fixed-quantity fuel chamber, and a fuel delivery path that communicates with an intake passage and the fixed-quantity fuel chamber, the fuel delivery path having a manually operated open/close valve biased to a closed position;

a valve spring biasing the open/close valve to a closed position;

a starter bar operably coupled on a first end to the open/close valve and operable from a second end exterior to the carburetor and starting device to manually open the open/close valve;

a stopper operably couplable to the open/close valve on a first end and on a second end to the first end of the starter bar, and a guide rod coupled on a first end to the diaphragm and engageable on a second end with the stopper to lock the diaphragm that has undergone displacement to an extent at which the internal capacity of the fixed-quantity fuel chamber has expanded to a predetermined level, the diaphragm being locked at the associated position and prevented from moving in a direction of contraction;

wherein upon manually opening of the open/close valve of the fuel delivery path at a state in which the fixed-quantity fuel chamber is enlarged and filled with a predetermined quantity of starting fuel the diaphragm contracts due to an elastic contraction force and discharges a given quantity of starting fuel to the intake passage via the fuel delivery path.

9. The carburetor according to claim 8, further comprising a fuel-ejecting path extending from the fixed-quantity fuel chamber for ejecting excess fuel.

10. The carburetor according to claim 8 further comprising a coil spring biasing the starter bar and stopper toward a state of locking.

11. The carburetor according to claim 8 further comprising a diaphragm spring urging the diaphragm in a direction of contraction.

* * * * *